United States Patent [19]

Slater et al.

[11] 4,006,970

[45] Feb. 8, 1977

[54] LASER LIGHT IMAGE GENERATOR

[75] Inventors: Dan Slater, Fullerton; Ivan M. Dryer, Canoga Park; Charles W. McDanald, La Canada, all of Calif.

[73] Assignee: Laser Images Inc., Van Nuys, Calif.

[22] Filed: July 14, 1975

[21] Appl. No.: 595,516

[52] U.S. Cl. ..... 350/285; 84/464; 240/10 R

[51] Int. Cl.[2] ..... G05D 25/00; A63J 17/00

[58] Field of Search ..... 84/464; 40/106.52, 106.53, 40/130 B, 132 E, 132 F; 240/10 R, 10.1, 46.59; 272/8 R, 8 D, 8 P; 350/168, 285

[56] References Cited

UNITED STATES PATENTS

| | | | |
|---|---|---|---|
| 1,977,997 | 10/1934 | Patterson | 84/464 |
| 3,590,681 | 7/1971 | Cross | 84/464 |
| 3,591,250 | 7/1971 | Feinstein | 350/285 |
| 3,679,888 | 7/1972 | Reiback | 40/106.52 |
| 3,757,106 | 9/1973 | Bau et al. | 240/10 R |
| 3,907,430 | 9/1975 | Mann | 350/168 |

*Primary Examiner*—John K. Corbin
*Assistant Examiner*—Richard A. Rosenberger
*Attorney, Agent, or Firm*—Lindenberg, Freilich, Wasserman, Rosen & Fernandez

[57] ABSTRACT

A system is provided for generating a plurality of light images in different colors from a single laser light source, and moving these varying light images in predetermined paths in response to signals synchronized with music.

10 Claims, 11 Drawing Figures

LASER LIGHT IMAGE GENERATOR

BACKGROUND OF THIS INVENTION

This invention relates to a system for generating a plurality of predetermined different colored light images from a single laser light source, each of a single or multiple color. These images may be moved in predetermined paths for entertainment purposes.

For entertainment purposes a laser has been used as a light source from which a plurality of different color light beams are derived. These beams are directed at sets of mirrors which are moved, in response to electrical signals, along $x$ and $y$ axes.

Each light beam is reflected from a mirror set onto a screen where it describes a light image in color. The image formation and motion may be set to music.

Thus far, the images have been made of a single color. If it were possible to generate images each of which were made of one or a multiplicity of colors which can be readily changed, the image entertainment value would be greatly enhanced.

OBJECTS AND SUMMARY OF THE INVENTION

An object of this invention is to provide a light image generating apparatus which can generate different light images each of changing or multiple colors.

Another object of this invention is to provide a light image generating apparatus wherein the light images can be made to move in time to music of different tempos.

Still another object of this invention is to provide novel and unusual light image generating apparatus.

The foregoing and other objects of the invention are produced by using a laser as a light source. The laser output is broken into four different colored light beams. These light beams may be routed to one or more different panels. One of these panels has a plurality of means wherein each of the means may select a single color light beam. Each single color light beam is directed to movable mirror means which redirects the light beam onto a screen and, in response to signals can move the light beam in any $x$ and $y$ direction at speeds which, to the eye, look like a colored line, or circle, or pattern depending upon the motions of the mirror means. Means are provided for rapidly changing the color of the light directed at a mirror means whereby the color of an entire image or of parts of an image being formed are changed so that one can have an image made of multiple colors. A second panel has a plurality of interference wheel means each comprising a mirror which can select one or more of the light beams and direct them through translucent material which give the light beam passing therethrough a desired pattern, which appears upon the screen. The effect produced is heightened by moving the translucent material by means of a motor whereby changing patterns are produced on the screen. In addition, the laser beam may be directed at rotating wheels covered with a material that deforms in response to the heat of the laser beam. The light is reflected from these wheels onto the screen and also produces very interesting, unusual, and repeatable light patterns.

The novel feature of the invention are set forth with particularity in the appended claims. The invention will best be understood from the following description when read in conjunction with the accompanying drawings.

PROGRAM: BRIEF DESCRIPTION OF THE DRAWINGS

DESCRIPTION OF THE EMBODIMENT OF THE INVENTION

Figure 1:
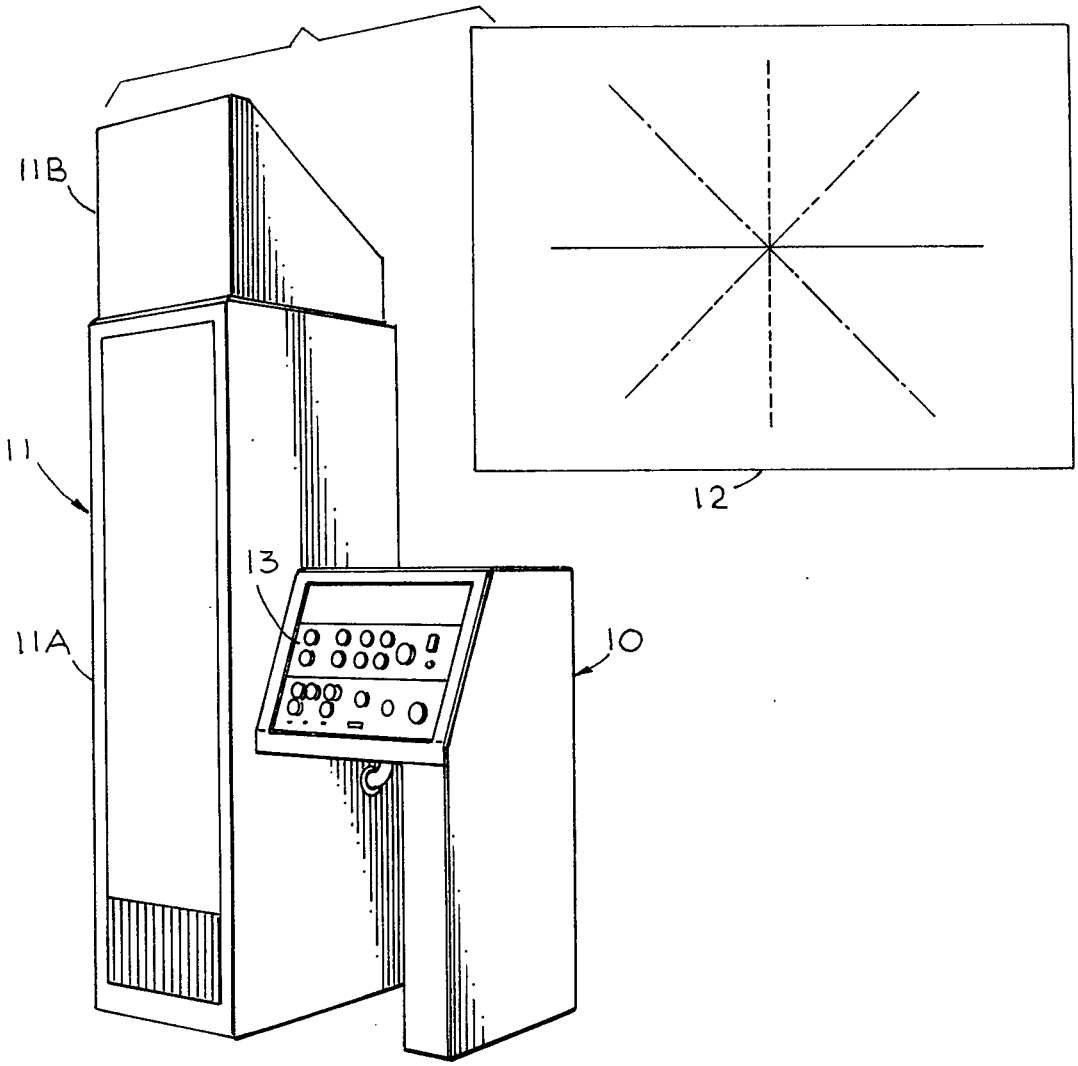
FIG. 1 is a schematic drawing illustrating the outward appearance of the apparatus in accordance with this invention.

Referring now to FIG. 1, there is shown a housing 10 which contains the controls which generate electrical signals which determine the light patterns produced by the light pattern generating equipment, represented by the console 11. These light patterns are projected on a screen 12. The light pattern shown on the screen, is, by way of illustration. Each one of the lines represented on the screen is of a different color. This pattern is only one of many which can be made individually or simultaneously using the equipment described herein. This pattern may be made to rotate, or move in any of the $x$ and $y$ directions. Also, a multiplicity of different patterns may be simultaneously generated and projected on the screen in accordance with this invention. The motion of the light patterns may be set to music so that the images literally dance and gyrate in time with the music. Patterns may be selected and moved by means of controls, for example on the control box or may be automatically selected and moved from a signal source, such as a tape upon which are recorded not only the music but also the control signals for selecting and moving the light patterns. The console 11 includes a lower half 11A which contains a laser tube and the power supply therefor and 11B which contains the light image generating equipment.

Figure 2:
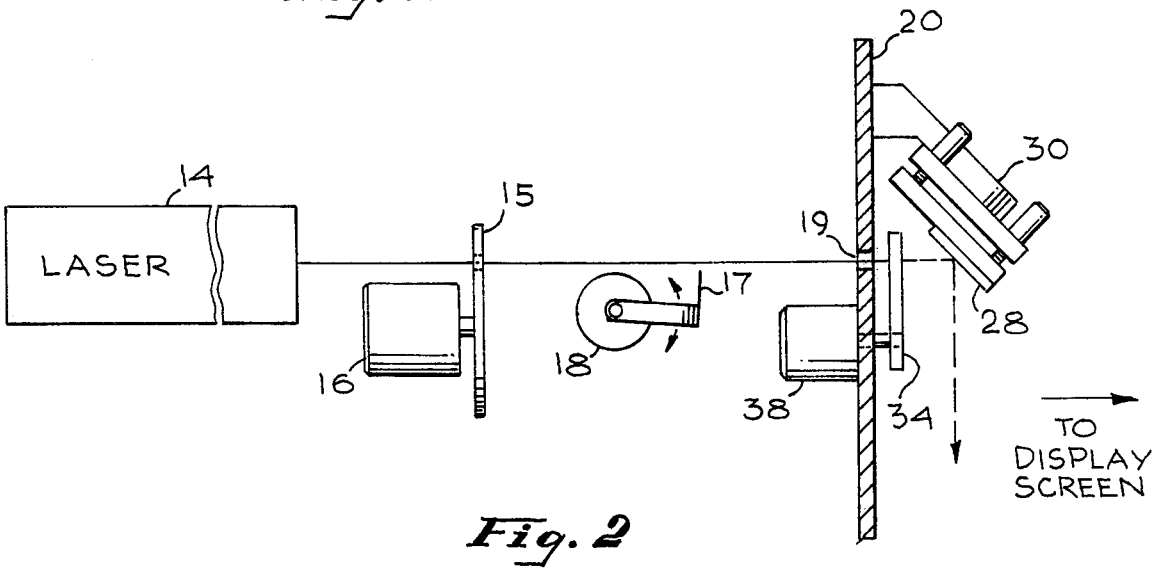
FIG. 2 is a view of apparatus for chopping the laser beam and producing fade effects.

FIG. 2 is schematic diagram illustrative of the apparatus between the laser 14 and an input panel 20. The white light output of the laser passes through a light chopper 15, driven by a motor 16. The chopper consists of an opaque object is oscillated by a motor in a manner to chop the light beam at a frequency determined by the motor speed. Knife edge 17 is actuated by solenoid 18 for fading effects.

Figures 3A, 3B:
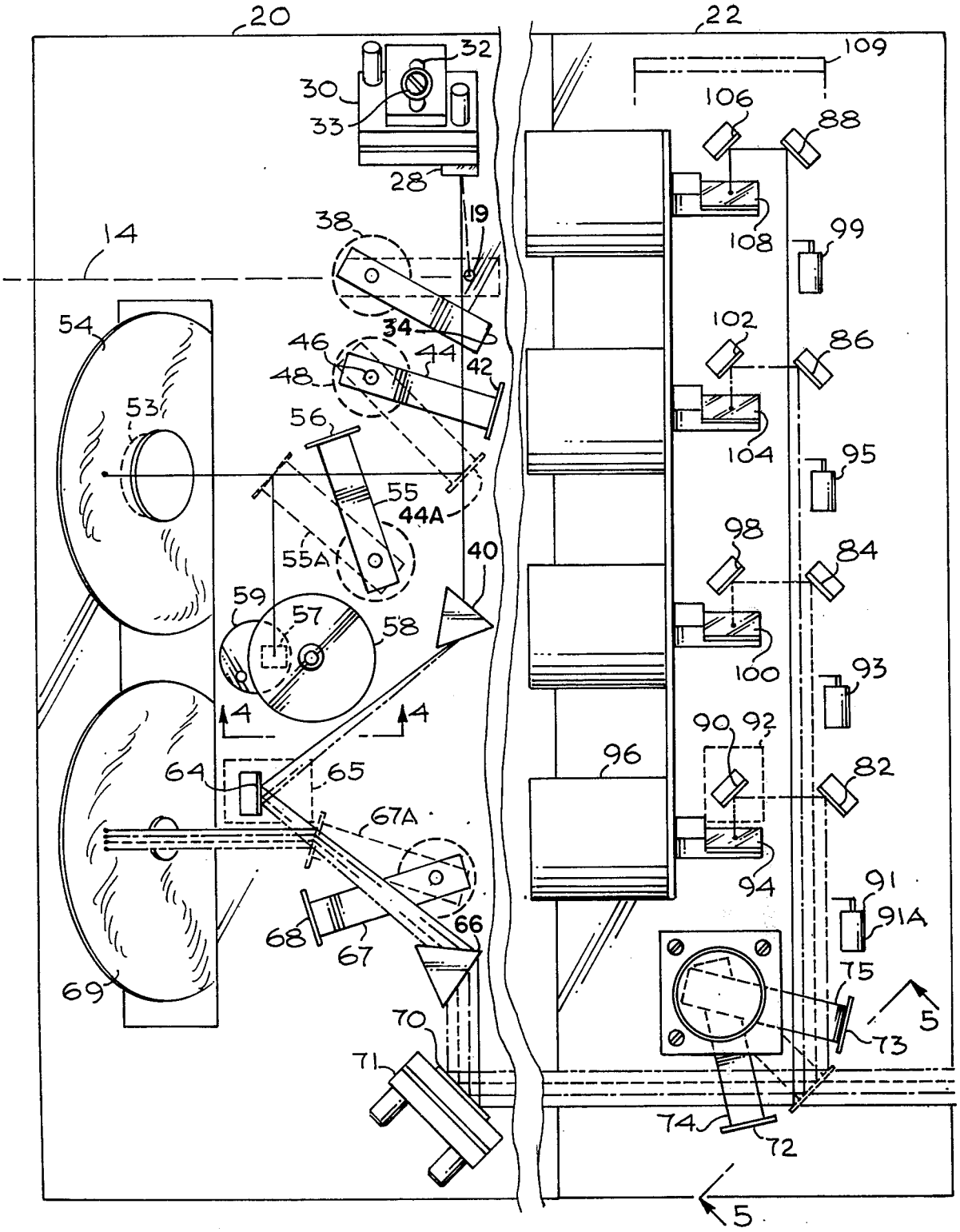
FIGS. 3A, 3B and 3C are a view in elevation of the light pattern generating equipment in accordance with this invention.
Figure 3C:
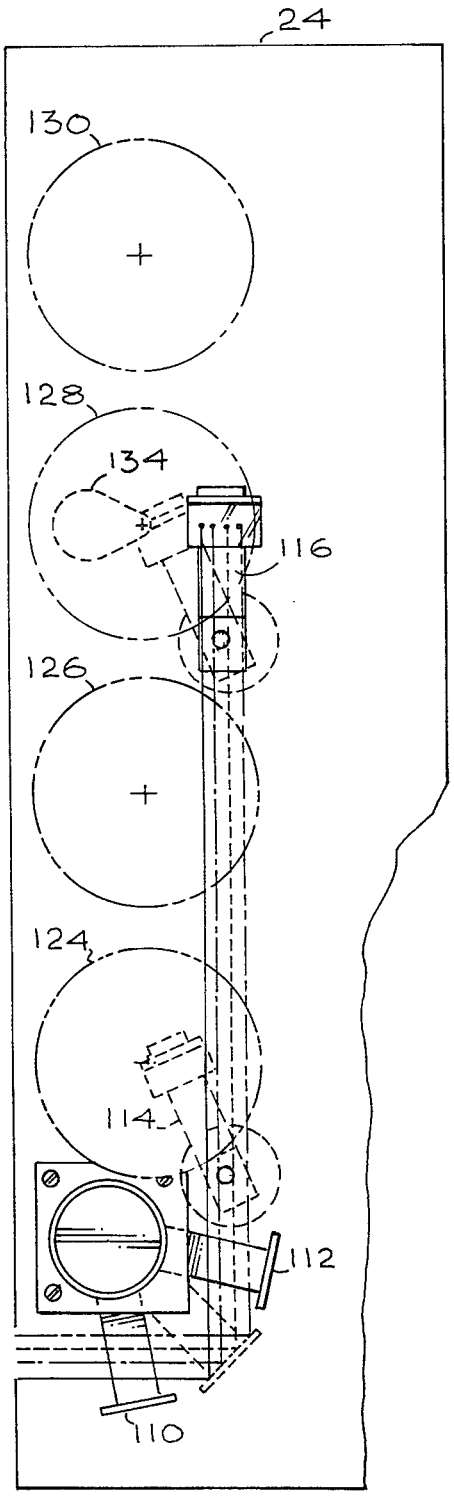

FIGS. 3A, 3B and 3C constitute a view of the light image generating equipment contained in the portion of the console 11B. The view here is that seen by an observer at the location of the screen. Besides the input panel 20, there are provided one or more scanner panels 22, and one or more interference panels 24. In order to assist in an understanding of this invention, the light beams derived from the laser including various colors are shown as dashed lines on the drawing. Light from the laser 14, shines through the hole 19 in the panel onto a mirror 28, supported by a adjustable mirror mount 30. The adjustable mirror mount has a slot 32 therethrough through which the screw 33, passes to attach it to the panel 20, whereby the adjustable mirror mount may be fixed to reflect the laser beam in a desired direction and then fastened down. The solenoid operated shutter 34, is positioned adjacent the hole in the panel through which the laser beam passes so that it may be actuated to block the laser beam from passing therethrough. The solenoid 38 is mounted on the opposite side of the panel 20 and is represented by dotted lines.

The mirror 28 directs the light beam onto a first prism 40. This prism divides the laser light beam into four primary colors. However, interposed between the mirror 28 and the prism 40 is a "first beam router" which comprises a solenoid actuatable mirror 42, mounted on a support 44, which is connected by means of a shaft 46, to the solenoid 48 mounted on the opposite side of the panel. The first beam router or solenoid actuated mirror 42 can be moved between the position shown in the drawing in solid lines which permits the laser light to impinge on prism 40 and the position shown by the dotted lines whereby the light beam is reflected onto a "burn wheel" 54. The burn wheel 54 is mounted on a motor 53, so that it can be rotated. The burn wheel is a wheel covered with a reflecting material, such as alominized Mylar, or an acetate, having the property that it deforms as a result of the heat caused by the laser light beam, which at this point is still an undivided beam. The light reflected onto the screen, as a result of this deformation has an unusual and intriguing pattern that is everchanging in its shape as the wheel rotates.

Still another effect is achieved when the first beam router is operated to the position represented by the dotted lines where it redirects the laser beam and prevents it from reaching the first prism 40. Second beam router 55, carrying a mirror 50, and also solenoid operated, and of the same construction as the first beam router, is shown in its inoperative position. Its operative position is shown by the dotted lines 55A. When operated to the position represented by 55A, the second beam router mirror 56 prevents the laser beam from reaching the burn wheel and redirects the beam so that it will impinge on a fixed mirror 57, shown in dotted lines, since it is beneath a motor operated wheel 58 which comprises a diffraction grating.

Figure 4:
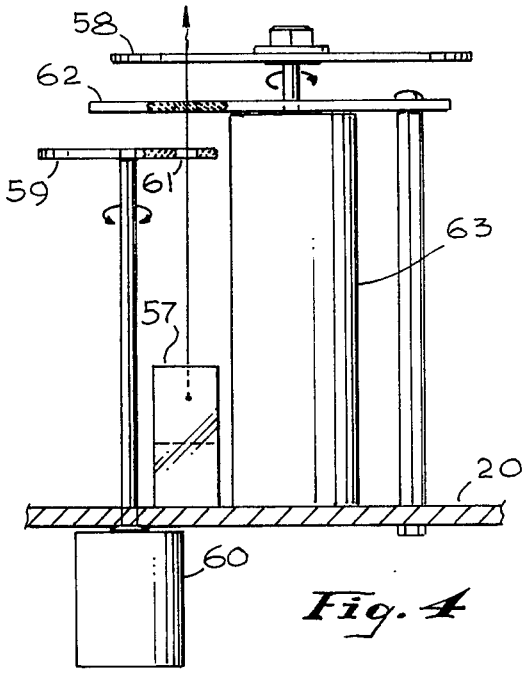
FIG. 4 is a view along the lines 4—4 in FIG. 3.

Reference is now made to FIG. 4, which is a view along the lines 4—4, and illustrates the apparatus used to obtain a "diffraction" effect, i.e. wherein a burst pattern is obtained with a central dot and radiating outwardly a plurality of different colored dots.

The fixed mirror 57 redirects the laser beam in a path to pass through a first diffraction grating 59, which is in the shape of a wheel supported on the shaft of a selsyn motor 60. The selsyn motor responds to signals of a remotely located selsyn motor which is at the location of a operator who can operate his motor to rotate the wheel 59 or to station it so that the light beam can pass through a hole in the diffraction grating wheel.

The laser light, after either passing through the first diffraction wheel material or through the hole therein, passes through a second sheet of material 62 which is a diffraction grating again, and is fixedly positioned. Following the second diffraction grating 62, is the second diffraction grating wheel 58, rotated by a motor 63, through which the laser light passes on its way to the screen. The hole 61 permits the operator to use two or three diffraction gratings as he wishes to achieve different effects.

In the event that the first and second beam router are not actuated, the laser beam can pass through the first prism 40, which breaks the beam into its various light components. These various light components comprise a plurality of colored beams which impinge upon a spring return limited rotation motor actuated mirror 64 called a beam torquer. The spring return limited rotation motor 65 which actuates this mirror is also represented by dotted lines and is mounted on the other side of the panel. The beam torquer, when actuated, has the ability to either oscillate the light beams or deflect the beams so that the output from a second prism 64 is made to move or stand still as desired. The beam torquer directs the plurality of light beams upon a second prism 66 for the purpose of making the beams parallel to one another.

A third beam router 67, similar in construction to the first and second beam router, is solenoid operated, and when operated pivots the mirror 68 that it moves from the position shown in the solid lines to the position 67A shown by the dotted lines. At the operated position the mirror 68 reflects the four colored beams into the surface of another motor driven wheel 69. This surface may be covered by a material, such as aluminum covered mylar, which deforms under the heat of the impinging beams and reflects what appears to be an everchanging cloud pattern in color on the screen.

If the first, second and third beam routers are not actuated, then the output of the second prism 66 will impinge upon an adjustable mirror 70, supported on an adjustable mount 71. The adjustable mirror directs the plurality of light beams along a path which is interceptable by a two solenoid operated device called a 50%–100% beam routing device. This comprises two solenoid actuated mirrors, one of which, 72, is shown in its actuated position, will reflect 100% of the light impinging thereon. The respective mirrors 72, 73 are mounted on support members respectively 74, 75 which are maintained at an angle relative to one another.

Figure 5:
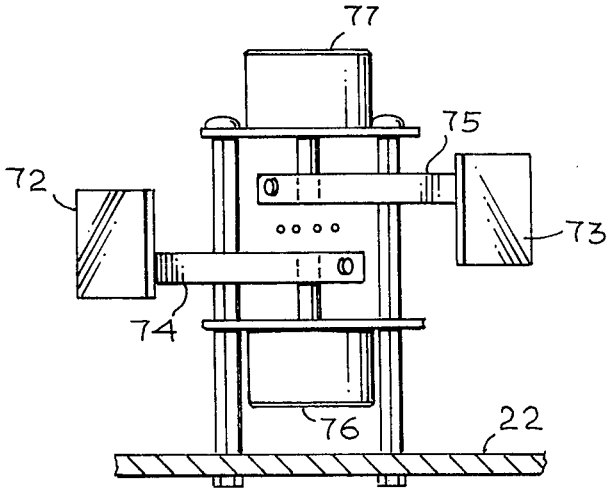
FIG. 5 is a view along the lines 5—5 in FIG. 3.

FIG. 5 is a view along the lines 5—5 on FIG. 3 and the construction of the 50%–100% beam routing device. The support member 74 is pivotably supported by a solenoid 76, and the support member 75 is pivotably supported by a solenoid 77. The entire 50%–100% beam routing device is supported on the panel 22.

The operation of the 50%–100% beam routing device is such that the positioning of one of the mirrors to intercept the light beam moves the other mirror out of the way. Thus, when the 100% reflecting mirror 73 is moved to the position represented by the dotted lines, the parallel light beams from the mirror 70 are redirected substantially at right angles from the path from which they come. When the 50% mirror 72 is in the operative position, then 50% of the light beams received are redirected at substantially 90°, and the remainder of the light beams pass through the mirror.

Stationary mirrors, respectively 82, 84, 86 and 88 are mounted on the panel at locations such that the first mirror 82, will intercept and redirect one of the four collimated light beams from the laser source; the second mirror 84, will intercept and redirect the second one of the four light beams; the third mirror 86 intercepts and redirects the third of the four light beams; and the fourth mirror 88, intercepts and redirects the fourth of the light beams.

The structures upon which the light beams, redirected by means of the mirrors 82–88, fall, are all identical, therefore only one of these need by described. These structures comprise a motor 92, which is mounted on the opposite side of the panel and therefore is represented by dotted lines. The motor 92 rotates the mirror 90 so that the light beam impinging thereon is moved along one axis, for example, the *x* axis. The motor is a spring return motor which rotates a predetermined amount in accordance with the amplitude of the signal applied thereto, and then, if the signal is removed or diminsshed, quickly rotates in the opposite direction either to the location determined by the diminished amplitude signal, or back to an initial position. These motors may hereafter be referred to as scanner motors. The light beam reflected from the mirror 90 impinges on a second movable mirror 94, which is also supported on the shaft of a spring return limited rotation motor 96. This second mirror rotates and thereby moves the beam along a second coordinate axis, for example, the *y* axis. The beam is reflected from the mirror 94 onto the screen 14. As previously, described, there are four sets of rotatable mirrors which are capable of moving the light beam along both *x* and *y* axes. Mirrors 90, 98, 102 and 106 are used for *x* axis motion and mirrors 94, 100, 104 and 108 are used for *y* axis motion. The mirrors 90, 94 have a light beam of one color directed thereon; the mirrors 98, 100 have a light beam of a second color directed thereon; mirrors 102, 104 have a third color light beam directed thereon; mirrors 106, 108 have a fourth color light beam directed thereon. From the foregoing it should be appreciated that the apparatus described, with proper motions of the respective *x* and *y* mirrors, can produce four separate light images of whatever pattern desired as determined by the signals which actuate the scanner motors which support and move these mirrors. Different types of Lissajous figures, stars, triangles, helices, cycloids, etc., are made possible with the means described.

Each different color light beam may be selectively turned off by selectively actuating the respective solenoid operated shutters, 91, 93, 95, 99. For example, when the solenoid 91A which operates the shutter 91 is actuated, it interposes the shutter in the path of one color light beam preventing it from reaching the stationary mirror 82. Thus a rapid blanking off, and appearance on, of each entire different color image may be achieved. The appearance and operation of these solenoid operated shutters is made clearer from FIG. 7.

It was previously indicated that the beam torquer 64, 65 can oscillate and thus move the colored light beam over an oscillatory and reciprocal path. By this type of oscillation a change in the color of the various images and or parts of the various images generated by the movable mirrors 90, 94 through 106, 108 as well as cutting off of the light images is made possible. For example, if the beam torquer moves so that the beam which impinges upon mirror 82 misses it and impinges upon mirror 84, the image produced by mirrors 90, 94 is blanked out and the image produced by the other movable mirrors have their colors changed at that instant. As oscillation of the beam torquer in the opposite direction can have the effect of blanking out or changing the color of the image produced by the mirrors 106, 108 while the images produced by the other mirrors have their colors changed. As a consequence of the foregoing operation, a capability is provided whereby a number of single images are created, each made up of different colors.

Figure 7:
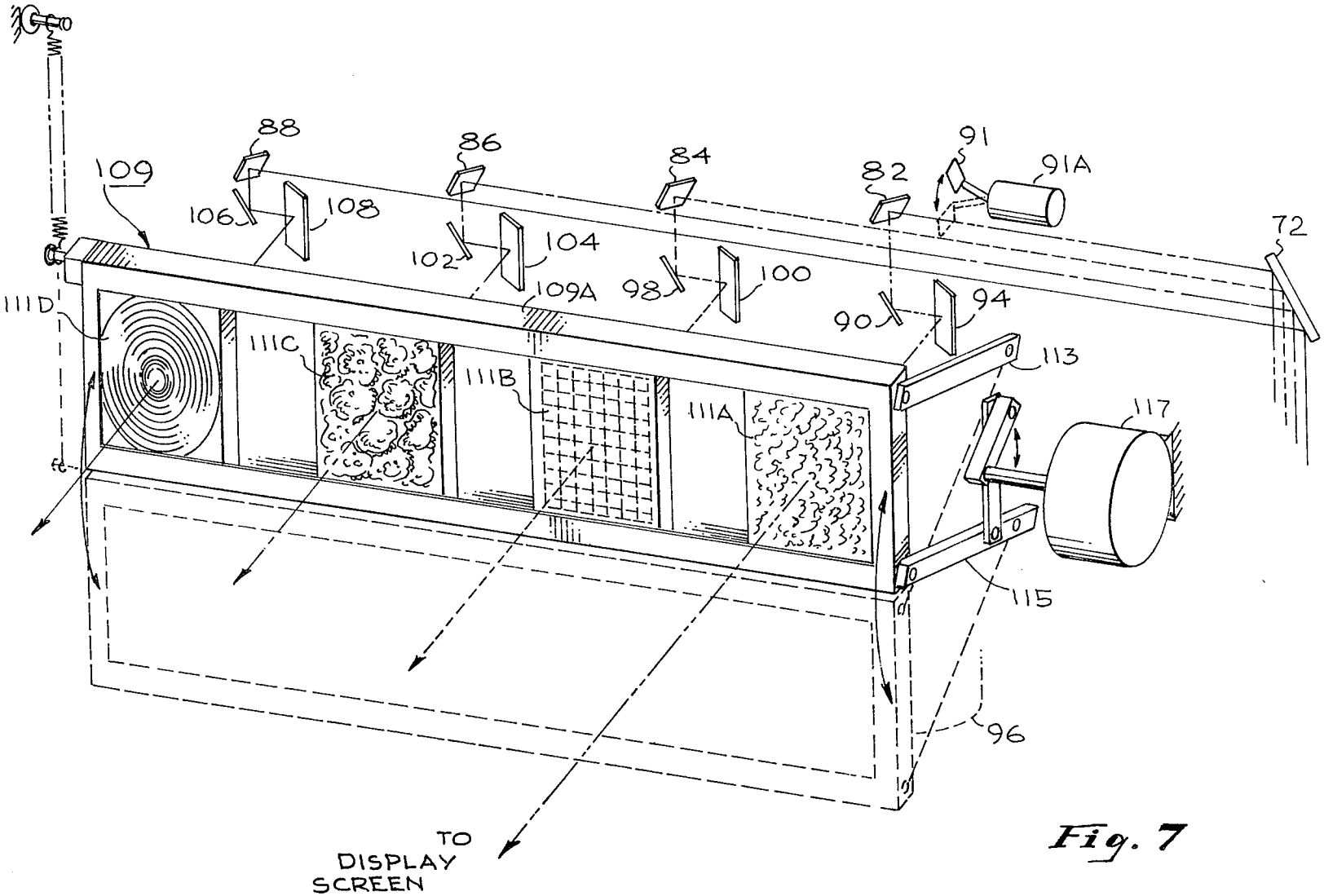
FIG. 7 is a view in elevation of the scanner glass panel used in the invention, and FIGS. 8*a*/8*b* is a block schematic diagram of an electronic control system used to control the light pattern generating equipment of this invention.

FIG. 7 is a perspective view of a glass panel 109, which, although associated with the structures shown in FIG. 3B, is shown separately in order to avoid confusion in the drawings. The glass panel constitutes four separate translucent textured glass or plastic sheets, respectively 111A, 111B, 111C and 111D, which are supported in a frame 109A. The panel is attached to a pair of moveable arms 113, 115, which are actuated by means of a solenoid 117 to move the glass panel parallel to the front of the *x-y* mirror scanner panel from an inoperative position shown by dotted lines, where the respective textured glass sheets are out of the way of the light beams reflected off of the mirrors 94, 100, 104, 108 to the position shown where the light beams will pass through the respective textured glass sheets on their way to the screen. This adds other pleasing effects to the images that are seen, the specific effects being determined of course by the texture or pattern of the various glass sheets.

In the inoperative position the panel is positioned over the location of the scanner motors for the *x* and *y* motion mirrors. The solenoid 117 is mounted on the scanner panel 22 adjacent to the motor 97.

Figure 6:
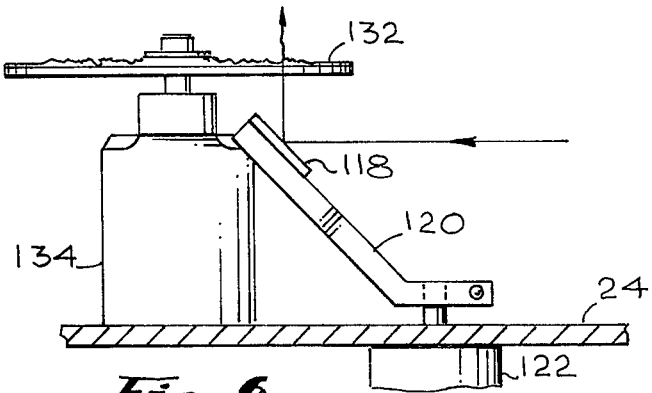
FIG. 6 is a sectional view illustrating a beam selector in accordance with this invention.

When the 50% mirror 70 is in the beam interception position, the light beams that pass therethrough are intercepted by one or the other of the mirrors 110, 112 of a second 50%–100% beam routing device. With the 50% mirror 110 at the beam interception position, 50% of the beam can be passed therethrough to other panels, not shown, for generating light images. The remainder of the beam, is redirected substantially at right angles for selection by light beam selectors, 114, 116, only two of which are shown for clarity in the drawings. There are four of these light beam selectors, and the details of one of these is shown in FIG. 6. Each light beam selector comprises a mirror 118, mounted on a holder 120, which is pivotably supported on the shaft of the rotary solenoid 122.

The beam selector mirrors can be rotated so that the beam selector 114 will intercept one or more of the beams redirecting them so that they will impinge upon an "interference wheel" 124.

There are four of these interference wheels, respectively 124, 126, 128, and 130, each associated with a beam selector mirror. These interference wheels are closest to the viewer. Each interference wheel comprises a segment of a translucent material 132, which has the property that it will diffuse the light impinging thereon permitting it to pass therethrough and produce an interesting light pattern such as a cloud or other light pattern in the color or colors selected by the associated beam selector. The interference wheel material 132 may be for example, textured or patterned glass or plastic material or a holographic replica of a diffraction grating. This material is mounted upon the shaft of the motor 134, which rotates, to provide interesting changing patterns in color, on the screen.

From the foregoing description it should be appreciated that a multiplicity of light images may be generated and displayed, and moved, each of a single color or a multiplicity of colors, and each image can be a solid line or an interrupted line image. It is possible to provide a plurality of manual controls whereby electrical signals of varying amplitudes and phase relationships can be applied to the various solenoids and scanner motors to achieve desired light images of varying sizes and displacements. However, while manual control is possible, a better arrangement for controlling the various motors and solenoids is to provide electrical circuits, which for example, can actuate the scanner motors to move in well known manner to generate Lissajous figures, cycloids, spirals, etc., and to apply the amplified output signals from these various circuits to the scanner motors on the scanner panel. These circuits are well known. For example, it is well known how to generate any of the patterns mentioned by applying $x$ and $y$ signals to the $x$ and $y$ deflection termianls of a cathode ray tube. Substantially identical equipment with suitable amplification apparatus may be used for driving the scanner motors to cause the associated mirrors to move in the $x$ and $y$ directions to create the same images that are created with a cathode ray tube. The effects obtained with the chopper and beam torquer are analagous to those obtained with a $z$ axis on, or, of a penetration type cathode ray tube device.

A preferred way of not only generating the light images by the scanner panel but also controlling the other solenoids in the input and interference panels is to record on tape signals for selectively actuating the various electrical circuits. Also recorded on the tape is music which it is desired to reproduce and to which it is desired that the light images appear and dance. Such tape recording techniques are also well known. What this requires is a keyboard, with potentiometer and or key controls wherein each control is associated with the desired image actuation of a control which generates code signals which select and pass to driving circuits the signals from whichever one of the image electrical signal generating circuits it is desired to display. At that time, or on a replay, analog signals may be recorded which may be used for controlling size and/or placement of the generated image. Such generation recording of control signals together with audio signals has been done, for example, in the amusement field where it is desired to have an anthropomorphic dummy move and speak or sing.

Figure 8A:
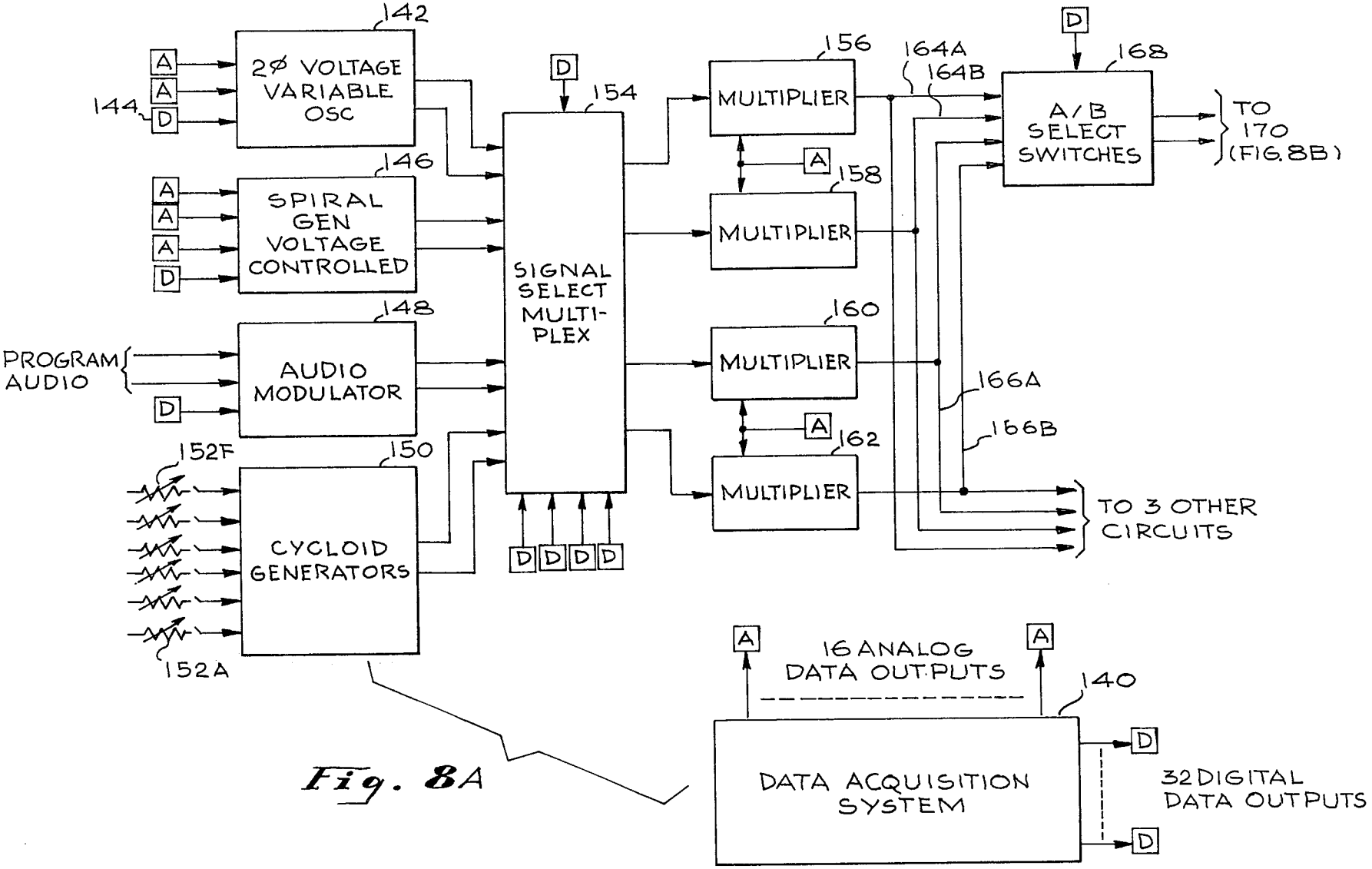
Figure 8B:
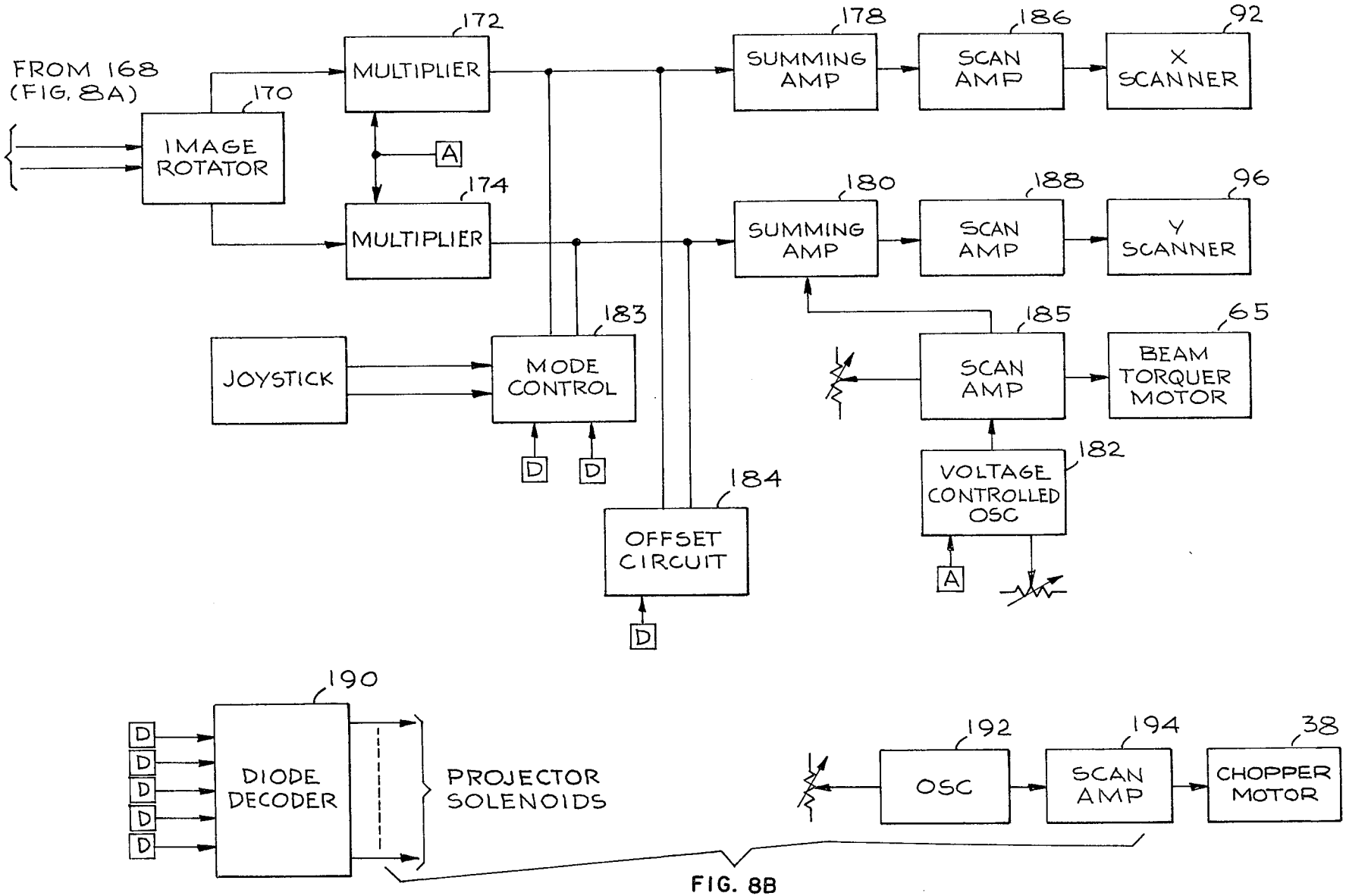

FIGS. 8A and 8B are block schematic diagrams of a system for operating the color image generator shown in FIG. 2 electrically, and which is shown for illustrative purposes. A source of analog and digital signals 140 labeled "data acquisition system", of the type described, that is a tape player having a tape whereon are recorded control signals in association with music, provides the signals to various parts of the electrical circuitry, as will be described. There are, by way of example, sixteen analog data outputs and thirty-two digital data outputs. The tape has the required tracks, for recording both the audio and control signals. The tape player includes the apparatus for decoding and routing the control signals to the various parts of the circuits to be controlled thereby. These are also well known techniques.

One circuit, which may be employed for generating patterns, by way of example, is a two-phase voltage variable oscillator 142. It generates two sine wave oscillations whose phase can be varied from in-phase to out of phase at a rate which can be also controlled by signals from the data acquisition system. The digital input, represented by the rectangle 144 labelled "D", is used to bring both sine waves into phase. The other inputs control the rate and direction of phase change of the signal. A voltage controlled spiral generator 146 may be controlled, in a well known fashion, from the outputs from the data acquisition system 140, to produce a spiral image generating signal at a desired rate and either spiralling from a dot outward or from a completed spiral down to a dot. The digital signal input turns the spiral generator on, and the analog signal inputs reset the spiral generator and also control the rate and direction of spiral.

A rectangle designated as audio-modulator, 148, receives the program audio input, and when enabled by the digital signal input, provides two outputs, one of which comprises signals above one Khz and the other of which comprises signals below one Khz. The high frequency signals are converted to dc which then is used to modulate the amplitude of the signal applied to the scanner whereby image size may be increased with high frequency program and level. The low frequencies are applied to the scanners to be used as deflection signals for an image resulting in an $x$-$y$ display of right and left side information.

A cycloid generator 150, comprises by way of example, three quadrature oscillators, which have their phase and amplitudes established by the settings of the six potentiometers 152A–152F, at their inputs. Two of these potentiometers are assigned to each one of the oscillators.

The three electrical signal pattern generators, as well as the audio-modulator outputs are applied to a signal selecting multiplex circuit 154. This is a circuit which can select a program when enabled by the digital signal shown at the top of the rectangle. It can select any two of the inputs, in accordance with the digital signal input shown applied at the bottom of the rectangle. In addition, the output of the audio-modulator may be applied to modulate the electrical signal patterns which have been selected.

One of the two programs which is selected by the signal multiplex circuit 154, is applied to two multipliers respectively 156, 158, the other of the programs which has been selected is applied to two other multipliers respectively 160, 162. On the assumption that one of the selected programs is the two outputs from the two phase variable oscillator 146, which represent the $x$ and $y$ signals required for generating circles, these $x$ and $y$ signals are applied to the respective multipliers 156 and 158. The amplitude or gain which these multipliers provide, is in response to an analog signal input from the data acquisition system. The output of these two multipliers is applied to two busses respectively 164A and 164B which carry the respective $x$ and $y$ signals. Similarly, the output of the respective multipliers 160 and 172 is applied to two busses respectively 166A and 166B.

The busses 164A, 164B, and 166A, 166B connect to four similar circuits, only one of which is shown, to reduce the complexity of the drawing. These four circuits are used to drive the four $x$ and $y$ scanner motors on the scanner panel.

All of the busses connect to circuitry designated to A/B select switches 168. These select switches, in response to a digital signal input from the data acquisition system will select one or the other of the two programs on the incoming busses. The output of the A/B select switches is applied to an image rotator 170, which is a circuit that establishes the phases and thus the orientation of the color signals as they control the display.

The output of the image rotator 170, consisting of $x$ and $y$ signals, is applied to two multipliers 172 and 174, whose gain is controlled by the analog signal applied to their inputs. Two multiplier outputs are applied to two summing amplifiers respectively 178, 180. These summing amplifiers add voltage inputs from a mode control circuit, which is controlled in response to digital signal inputs. The mode control circuit can provide voltages to the summing amplifiers which cause an "in phase" mode of operation or in a second mode which can cause an "out of phase" mode of operation. This is done by controlling the phase of the a/c signal provided by the mode control for each one of the four circuits through the summing amplifiers of each one of the four circuits. The joystick is a manual control which generates *x* and *y* signals according to its position, which are added to the signals of the image generators whereby the images are displaced to the location indicated by the joystick position. The joystick signals may be used alone, or added to those of the mode control in which event, when the "in phase" mode of operation is provided, identical signals are presented to each pair of scanner motors and any movement of the joystick causes all *x-y* mirror pairs to be moved about in a similar manner and direction. For example, a clockwise movement of the joystick causes all patterns to move clockwise.

When the mode control is providing "out of phase" signals, the *x* and *y* signals generated by the joystick are interposed and polarity inverted in a manner so that when applied to the scanner motors, for example, a left movement of the joystick moves one image pattern to the left, another to the right, the third up and the fourth down. A clockwise movement of the joystick causes diametrically opposite image patterns to move in opposite directions. Thus, of the four image patterns displayed, two move clockwise and two move counter clockwise.

In order to displace the images produced, displacement signals are provided by an offset circuit 184, in response to a digital signal input. The displacement signal can constitute d/c signals which are applied to the summing amplifier inputs.

Another input to the summing amplifier 180 is an oscillation signal which is generated by a voltage controlled oscillator 182 when enabled by an analog input, and amplified by a scan amplifier 184. This has the effect of modulating the other inputs to the summing amplifier with an oscillating signal of correct amplitude whereby the mirror which controls *y* axis position oscillates to cancel out unwanted movement of the light beams along the *y* axis caused by the scanning action of the beam torquer mirror 64. The scan amplifier 184 output is also applied to the motor of the beam torquer. This causes color interchange, as described in connection with FIG. 3A, B & C.

The summing amplifier outputs respectively 178, 180 are applied to scan amplifiers respectively 186, 188, which convert the voltage signal to current signals. The scan amplifier outputs are respectively applied to scanning motors 92 and 97 for the *x* and *y* axes.

Control of the various solenoids described in connection with FIG. 2 is in response to the outputs of a read only memory 190, which provides the required outputs to the various solenoids described in connection with FIGS. 3A, 3B, 3C and 7, in response to digital inputs derived from the data acquisition system. Finally, the shutter control, when it is desired to chop the laser light, is provided by the output of an oscillator circuit 192, which is applied to a scan amplifier 194, which drives the chopper motor.

The foregoing circuit arrangement is by way of example and not to be taken as a restriction upon the invention. Other electrical signal pattern generators may be employed and their outputs controllably selected, modulated, and amplified, or displaced in a manner well known to the art to provide *x* and *y* signals for driving the scanner motors whereby the various patterns in various colors are generated. The data acquisition system has been exemplified as a tape pre-recorded with music and control signals. Control signals may also be computer generated in response to a program. These techniques are known to those skilled in the art.

There has accordingly been described and shown here a novel and useful light image pattern generator controllable to generate an extremely wide range of different light images which are substantially randomly movable and which either independently, or coupled with music, have a substantial entertainment value.

The embodiments of the invention in which an exclusive property or privilege is claimed are defined as follows:

1. A system for generating light images of various colors comprising laser means for generating a single light beam capable of being separated into a plurality of different color light beams, first prism means for producing as an output a plurality of different color light beams from said single light beam, first mirror means for directing said single light beam on said first prism means, second prism means for collimating the output of said first prism means to produce as output a plurality of different color light beams having spaced parallel paths, a plurality of spaced aligned moveably *x-y* mirror means each respectively moving a light beam thereon in a manner to describe a desired pattern, second mirror means positioned for directing said output of said second prism means along a path parallel to a line defined by said spaced, aligned, moveable *x-y* mirror means, a plurality of third mirror means respectively positioned in said path adjacent said plurality of moveable *x-y* mirror means for directing a different one of said collimated different color light beams onto a different one of said moveable *x-y* mirror means, and beam torquer means for reciprocally moving the light beams directed at said second mirror means whereby each of the patterns described by said moveable *x-y* mirror means is made to change color.

2. A system for generating light images as specified in claim 1 where in said beam torquer means is positioned between said first and second prism means for directing the different color light beam output of said first prism means onto said second prism means.

3. A system as recited in claim 2 wherein said beam torquer means includes a beam torquer mirror, and motor means for reciprocally moving said beam and torquer mirror.

4. A system as recited in claim 3 wherein there is included, a source of signals for actuating said motor means, and means for applying signals from said source to said plurality of moveable *x-y* mirror means for compensating for any adverse effects created in the light patterns created as a result of reciprocal motion of said beam torquer mirror.

5. A system as recited in claim 1 wherein said second mirror means includes a fifty percent reflecting mirror means for directing fifty percent of the light of the collimated different color light beams along said path and passing therethrough the remainder of said light, a one hundred percent reflecting mirror means for directing one hundred percent of the light of the collimated different color light beams along said path, and means for selectively positioning either said fifty percent reflecting mirror means, or said one hundred percent reflecting mirror means, or neither, to intercept and direct said collimated different color light beams along said path.

6. A system as recited in claim 5 wherein there is included a plurality of spaced translucent light interference wheel means, a motor means for rotating each of said plurality of spaced translucent light interference wheel means, fourth mirror means positioned for receiving the light passed by said second mirror means and redirecting it along a path parallel to said plurality of spaced translucent light interference means, and a plurality of selectively moveable fifth mirror means positioned adjacent said path parallel to said spaced translucent light interference means for selectively intercepting and redirecting said collimated different color light beams or one of said plurality of spaced translucent light interference wheel means to pass therethrough.

7. A system as recited in claim 1 wherein there is included a plurality of selectively actuatable shutter means each positioned before and to one side of each of said plurality of third mirror means for preventing interception of one of said collimated different color light beams by one of said third mirror means.

8. A system as recited in claim 1 wherein there is included a sheet of translucent material having a light modulating pattern therein for each of said moveable *x-y* mirror means, means for moveably supporting each said sheet of translucent material adjacent a different one of said moveably *x-y* mirror means, and means for moving each said sheet of translucent material in the path of the light output from each of said moveable *x-y* mirror means.

9. A system as recited in claim 1 including, rotably mounted diffraction grating means, means for rotating said rotatably mounted diffraction grating means, moveable sixth mirror means for intercepting and redirecting said single light beam, when actuated, to pass through said rotatably mounted diffraction grating means.

10. A method of generating multi-colored light images from a laser which produces light capable of being split up into a plurality of different color light beams comprising:

producing a plurality of different color light beams from said laser output, including directing said laser output at prism means for obtaining a plurality of collimated different color light beams, directing each different color light beam at a different set of *x-y* axis movable mirror means including, directing the plurality of collimated different color light beams along the path adjacent to the location of said plurality of sets of *x-y* movable mirror means, and successively intercepting a different one of said different color light beams in said path and directing the intercepted beam at a different one of said plurality of sets of *x-y* axis movable mirror means, moving each set of *x-y* axis movable mirror means in a predetermined manner to cause the light beam reflected therefrom to describe a desired image, and changing the color of the light beam directed at each set of *x-y* axis movable mirror means while the set is describing a desired image, to produce a multiple color image, including moving the plurality of different color collimated light beams in a manner to cause interception and direction of one or more color light beams, each of which is directed at one of the plurality of sets of *x-y* mirror means which thereby intercepts and directs a color light beam which is of different color than the color light beam intercepted when said plurality of collimated different color light beams are stationary.

* * * * *